US005362061A

United States Patent [19]

Napolitano

[11] Patent Number: 5,362,061

[45] Date of Patent: Nov. 8, 1994

[54] GAME BOARD APPARATUS

[76] Inventor: Patricia A. Napolitano, 59 Harwick Rd., Lopatcong, N.J. 08865

[21] Appl. No.: 167,735

[22] Filed: Dec. 15, 1993

[51] Int. Cl.[5] ..... A63F 3/00; G09B 1/14

[52] U.S. Cl. ..... 273/243; 273/148 A; 434/170; 434/370; 434/98

[58] Field of Search ..... 273/243, 148 A, 249, 273/272, 276, 293; 434/170, 370, 98

[56] References Cited

U.S. PATENT DOCUMENTS

| | | | |
|---|---|---|---|
| 1,787,521 | 1/1931 | Harrington | 273/146 |
| 2,852,260 | 9/1958 | Caffrey | 273/249 |
| 3,817,531 | 6/1974 | King et al. | 273/243 |
| 3,823,492 | 7/1974 | Allain | 434/170 |
| 4,378,214 | 3/1983 | Scherer | 434/170 |
| 4,682,777 | 7/1987 | Wood | 273/243 |
| 4,877,254 | 10/1989 | Yuscavage | 273/249 |
| 4,900,031 | 2/1990 | Wohl | 273/243 |
| 4,979,324 | 12/1990 | Rehtmeyer et al. | 273/254 |
| 5,114,147 | 5/1992 | Faylo | 273/146 |
| 5,167,503 | 12/1992 | Jordan | 434/128 |
| 5,249,808 | 10/1993 | Batte | 273/249 |

FOREIGN PATENT DOCUMENTS

| | | | |
|---|---|---|---|
| 2738798 | 3/1979 | Germany | 273/249 |

*Primary Examiner*—Benjamin H. Layno

[57] ABSTRACT

A board game apparatus, comprising a flat, multi-sided game board having a course of successive playing spaces generally positioned along the periphery thereof, successive ones of the spaces being colored with one of a given plurality of colors, a chance device, operable by a player, for selecting one color of the plurality of colors, a manually operable playing piece for each player participating in the game, for indicating the current spatial position of each player along the course, a plurality of groups of color cards, where all the cards of each group of cards are the same color, and each group of cards being a different one of the plurality of colors; and a plurality of color card folders, at least a portion of each folder being colored a different one of the plurality of colors and having a plurality of compartments defined therein which are dimensioned so as to individually receive color cards therein.

6 Claims, 1 Drawing Sheet

GAME BOARD APPARATUS

BACKGROUND

1. Field of the Invention

The invention relates to an educational game board apparatus, and more particularly, to a game in which the players (e.g., children) learn both the identification and the spelling of the basic colors in the environment of an entertaining game which requires no prior knowledge of reading or color names and can be played with very little adult supervision.

2. Brief Description of the Prior Art

There are many games commercially available which have educational aspects. However, most such games require that the players have at least a basic ability to read or understand the letters of the alphabet, as well as know the identity of different colors. Without such basic knowledge enjoyment of the game is lessened and/or more adult supervision is required.

It is an object of the present invention to enable children to learn the names of basic colors along with their spelling in an enjoyable and entertaining game atmosphere.

It is further object of this invention to provide such a game wherein very little adult supervision is required.

It is still a further object of the invention to provide such a game using apparatus which is relatively inexpensive to manufacture, thereby providing a low-cost educational game.

It is an even further object of the invention to provide such an educational game which incorporates not only chance elements for determining a winner, but which also involves skill in order to become a winner.

It is still an even further object of the invention to provide an educational game wherein the players do not have to hear or even speak to enjoy the game, and in the process learn both the identity of the colors and their spelling.

SUMMARY OF THE INVENTION

A board game apparatus, comprising:

- a flat, multi-sided game board having a course of successive playing spaces generally positioned along the periphery thereof, successive ones of the spaces being colored with one of a given plurality of colors;
- a chance device, operable by a player, for selecting one color of the plurality of colors;
- a manually operable playing piece for each player participating in the game, for indicating the current spatial position of each player along the course;
- a plurality of groups of color cards, where all the cards of each group of cards are the same color, and each group of cards being a different one of the plurality of colors; and
- a plurality of color card folders, at least a portion of each folder being colored a different one of the plurality of colors and having a plurality of compartments defined therein which are dimensioned so as to individually receive the color cards therein.

The above-noted features of the invention will be apparent from the following description of the preferred embodiment and from the claims.

For a fuller understanding of the invention, reference should now be made to the following description of the preferred embodiment of the invention and to the accompanying drawings.

DETAILED DESCRIPTION OF THE PREFERRED EMBODIMENTS

Equipment

Figure 1:
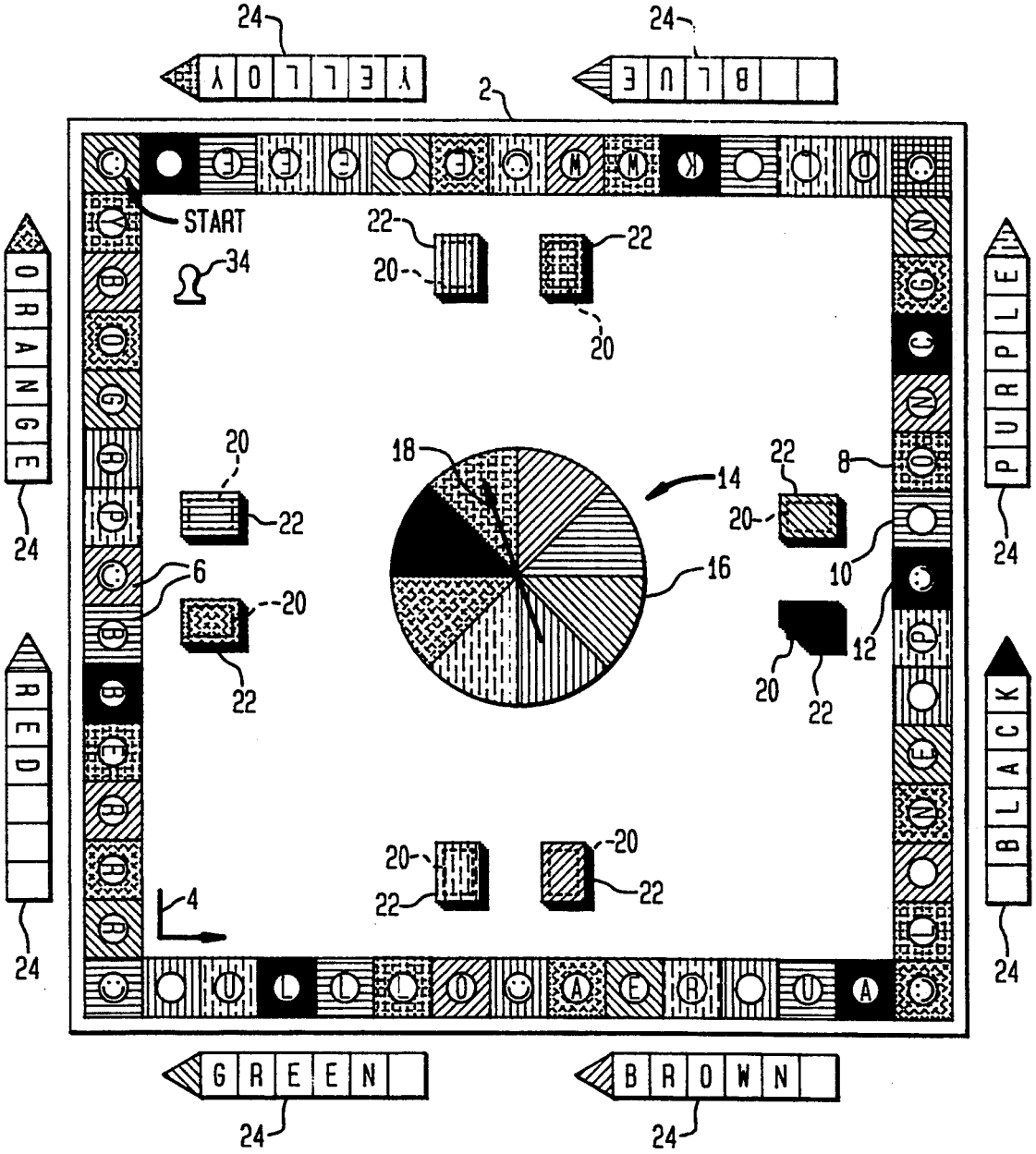
FIG. 1 is a plan view of a game board and associated apparatus, constructed in accordance with the principles of the present invention.

Referring to FIG. 1, the components of the present game board and associated apparatus are illustrated. A flat, generally rectangular game board 2, constructed of cardboard or other suitable material, has a continuous meandering course 4, formed by printing or other suitable marking thereon, generally about its periphery. As shown in the detailed portion of FIG. 1, which illustrates an enlarged section of course 4, the course is comprised of a continuous path of connected colored playing spaces 6. Each space comprises a colored square having an uncolored circular area centered therein. The color of each space 6 changes from one space to the next, using one of eight basic colors for each space. The colors may comprise, for example, yellow, orange, red, blue, green, purple, brown and black. Inside the circular area is either a printed letter of the alphabet which is used to spell the color of that space, a blank, or a smiley face. Circles 8, 10 and 12 are illustrative of the spaces having a letter, blank and smiley face, respectively, therein. Associated with one of the spaces (not specifically shown) is the label START.

A chance device 14 comprises a printed circular area 16 divided into eight pie-shaped sections, each section being colored one of the eight basic colors, and a spinner 18, comprising, for example, a crayon mounted on game board 2 for rotating movement over area 16.

Near the border of each side of game board 2 are two square areas 20, each square area 20 being colored with a different one of the basic eight colors. On top of each colored area 20, the user places a plurality of matching color cards 22, as will be described in greater detail below.

Eight color folders 24 are provided for use by the players, as will also be described below, for selectively receiving the color cards 22 of a specific color.

Figure 2:
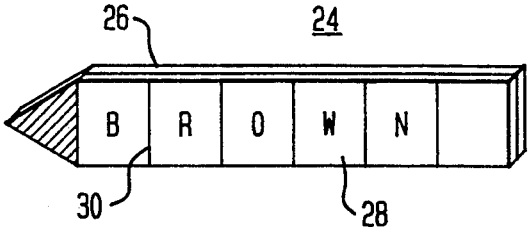
FIG. 2 is a perspective view of a color folder used with the game board of FIG. 1.

As shown in FIG. 2, each color folder comprises a crayon shaped folder 24 having a tip which is colored to match one of the basic eight colors, and includes a two-part body portion. A first part comprises a base 26 constructed, for example, from a piece of stiff cardboard, and a second part comprising a colorless and clear top portion 28 having the same shape as base 26, i.e., a crayon shape, and attached to base portion 26 by e.g., gluing at the tip and along the bottom edge of the crayon shape. Top portion 28 includes printed thereon a plurality of dark lines 29 spaced apart at various spaced positions along the length of folder 24 so as to define a plurality (e.g., six) of compartments 30. In a the preferred embodiment, top portion 28 can also be attached to base portion 26 (by, e.g., gluing) at spaced positions along the length of folder 24 corresponding to the position of lines 29, so as to more definitely form compartments 30. Compartments 30 are substantially the same shape as the matching color cards 22, but, as will be apparent from the description that follows, preferrably have a height which is greater than the width of folders 24. This will enable the players to more easily put the color cards 22 into and/or out of compartments 30. Printed on the top portion 28 for each compartment 30 in black block letter form is a letter which is used to spell one of each of the basic colors, with each folder having one of the colors spelled thereon. As illustrated in FIG. 2, the word B-R-O-W-N is spelled thereon, and the last compartment 30 has no printed letter. It is noted that the color folder 24 having the word O-R-A-N-G-E would have a printed letter on each of its six compartments 30. Thus, eight color folders 24 are formed, one each having a tip having a color corresponding to one of the basic colors, and the spelling of that basic color printed on the clear top portion 28 thereof. The spelling of the color starts with the first letter of the color being positioned over the compartment 30 nearest the colored tip of the folder and continuing along the length of folder 24 so that one letter of the color is aligned with successive ones of compartments 30. Since, when the game is formed using the English language, six letters are needed (for example, for spelling the color ORANGE), six compartments 30 are formed on folder 24. When the spelling of the color requires less than six letters, the remaining compartments 30 are left blank, i.e., unprinted.

The last components of the game are four differently colored pawns 32, used by the players to individually keep track of their advancement along the spaces of course 4.

Number of Players

Two, three or four players at a time are preferred.

Set-up of the Game

Each player takes a different one of the colored pawns 32 to identify that player and their current position as they progress along course 4 throughout the game. The pawns 32 are all initially placed at the space marked START along course 4.

The players are situated to each be along one edge of game board 2 and the two colored areas 20 facing each player become that players "colors".

Each player then takes the two color folders 24 having a colored tip which matches his color areas 20. Then, all the color cards 22 are placed over their respective matching colored area 20 (note, all of compartments 30 should be empty and not include any of color cards 22 therein, which may have been left there from a prior play of the game).

Object of the Game

The first player to fill all compartments 30 in both their color folders (i.e., both those with letters and those that are blank) with matching color cards 22, wins.

How to Play

1. One player is selected to go first and remaining players proceed in a clockwise order.

2. The first player spins the spinner 18 and proceeds along course 4 to the first space which matches the color that the spinner points to when it stops spinning. If the player has a folder 24 with a tip which matches that color, he takes a color card 22 of that color and places it into folder 24 as follows:

a. If the space is of the type having a letter indicated therein (e.g., space 8) and the player has that letter marked on one of his folders over an empty compartment 30, the player puts a matching color card 22 into that compartment 30.

b. If the space does not have a letter indicated thereon and instead is blank (e.g., space 10) and the space is of a color which matches the color of one of the two folders 24 held by the player, the player has the option to put the matching color card 22 in any desired, but unoccupied, compartment 30 of the matching color folder 24.

c. If the space is of the type having a smiley face indicated thereon (e.g., space 12), the player can place a color card 22 behind any letter of either one of his color folders 24.

3. If the player lands on a space which is already occupied, the player who is already there must go backwards to the preceding space and may pick-up a matching color card 22 in accordance with steps 2*a–c* if it is one of the players "colors".

4. If the player lands on a space having a color which does not match the color of either one of his color folders 24, his turn is ended, and then it is the next players turn.

5. Play continues in this manner with each player taking turns according to steps 2, 3 and 4, until a first one of the players has placed a matching color card in all six compartments of both of his two color folders 24. At that point in time, the color folders of the winner are filled with the matching color cards, and the spelling of that color, as printed on the clear top part 28 of each folder, is clearly displayed over the matching color cards. Thus, during the course of play the players learn to associate the letters which spell each of the colors, with the color that is being spelled, thereby mixing entertainment with the learning process.

Thus, there has been shown and described a novel board game which satisfies all of the objects and advantages sought therefore. Many changes, modifications, variations and other uses and applications of the subject invention will, however, become apparent to those skilled in the art after considering this specification and its accompanying drawings, which disclose preferred embodiments thereof. For example, chance device 14 could compriseany one of several suitable chance color indicators, such as an eight-sided die, having a differently colored side to indicate a different one of the eight basic colors. Although each player has two folders 24, each player could have only one folder or could even have three folders. Furthermore, although the English language is used to spell each color, clearly, other languages could be used with equal effect at providing an entertaining and educational game to teach the identity and spelling of colors. Still furthermore, although course 4 is illustrated as an endless loop, it could also comprise an open loop of continuous spaces, wherein the players proceed from an end of course 4 back to the START space after the end is reached. All such changes, modifications, variations and other uses and applications which do not depart from the spirit and scope of the invention are deemed to be covered by the invention which is limited only by the claims which follow.

What I claim is:

1. A board game apparatus, comprising:

a flat, multi-sided game board having a course of successive playing spaces generally positioned along the periphery thereof, successive ones of the spaces being colored with one of a given plurality of colors;

a chance device, operable by a player, for selecting one color of said plurality of colors;

a manually operable playing piece for each player participating in the game, for indicating the current spatial position of each player along the course;

a plurality of groups of color cards, where all the cards of each group of cards are the same color, and each group of cards being a different one of said plurality of colors; and a plurality of color card folders, at least a portion of each folder being colored a different one of the plurality of colors and having a plurality of compartments formed therein which are dimensioned so as to individually receive the color cards therein.

2. The game board apparatus of claim 1, wherein said color card folder comprises a base portion and a colorless top portion, with the top portion being attached to the base portion so as to define said compartments.

3. The game board apparatus of claim 2, wherein with the top portion has a plurality of spaced-apart lines formed thereon so as to define the edges of the compartments, and the letters which spell the one of the plurality of colors which matches the color of the folder are formed thereon by successively printing one letter on each one of successively adjacent compartments.

4. The game board apparatus of claim 2, wherein each color folder is generally formed in the shape of a rectangle with one end being the color which is printed on its colorless top portion.

5. The game board apparatus of claim 2, wherein the color cards are of a generally rectangular shape, and have a height dimensioned so that the height of the compartments of each color folder is less than the height of the color cards.

6. The game board apparatus of claim 5, wherein each color folder is generally formed in the shape of a crayon.

* * * * *